United States Patent [19]

Pawlenko

[11] Patent Number: 5,075,963

[45] Date of Patent: Dec. 31, 1991

[54] METHOD AND APPARATUS FOR ATTACHING SUCCESSIVE PAIRS OF WIRES TO A DATA CONNECTOR HAVING FINE-PITCH CONTACTS

[75] Inventor: Ivan Pawlenko, Holland, Pa.

[73] Assignee: AT&T Bell Laboratories, Murray Hill, N.J.

[21] Appl. No.: 603,357

[22] Filed: Oct. 26, 1990

[51] Int. Cl.[5] ..... H01R 43/04

[52] U.S. Cl. ..... 29/861; 29/33 M; 29/749; 29/753

[58] Field of Search ..... 29/749, 753, 33 M, 755

[56] References Cited

U.S. PATENT DOCUMENTS

| | | | |
|---|---|---|---|
| 3,995,358 | 12/1976 | Long et al. . | |
| 4,006,519 | 2/1977 | Long et al. | 29/749 |
| 4,014,087 | 3/1977 | Cover et al. | 29/721 |
| 4,027,368 | 6/1977 | Asick | 29/749 X |
| 4,034,472 | 7/1977 | Cover et al. | 29/749 |
| 4,126,935 | 11/1978 | Rhines et al. | 29/749 X |
| 4,517,718 | 5/1985 | Johnston, Jr. | 29/33 M |
| 4,549,343 | 10/1985 | Grubb et al. | 29/33 M |
| 4,870,747 | 10/1989 | Maack et al. | 29/753 |
| 4,878,295 | 11/1989 | Muhlberger et al. | 29/749 X |
| 4,903,399 | 2/1990 | Billingham et al. | 29/753 |
| 4,965,932 | 10/1990 | Billingham et al. | 29/749 X |

*Primary Examiner*—Carl J. Arbes

*Attorney, Agent, or Firm*—R. B. Levy

[57] ABSTRACT

An apparatus (40) for attaching successive pairs of wires (25) to successive pairs of opposed contacts (20) includes a pair of opposed ram assemblies (54), each provided with a knife blade (56) for ramming a wire against the contact for attachment thereto. Advantageously, the knife blade (56) is provided with a contact protector assembly (64) which serves to straddle the contact during wire attachment to protect the contact against deformation. The attachment apparatus (40) is also provided with a mechanism (88) for attaching each of a pair of strain reliefs (26,28) to the connector following attachment of the wires to the contacts to avoid the need to handle the connector between these two operations and to prevent any stress to the connection between the wire and contact.

19 Claims, 5 Drawing Sheets

FIG. 5
FIG. 5A
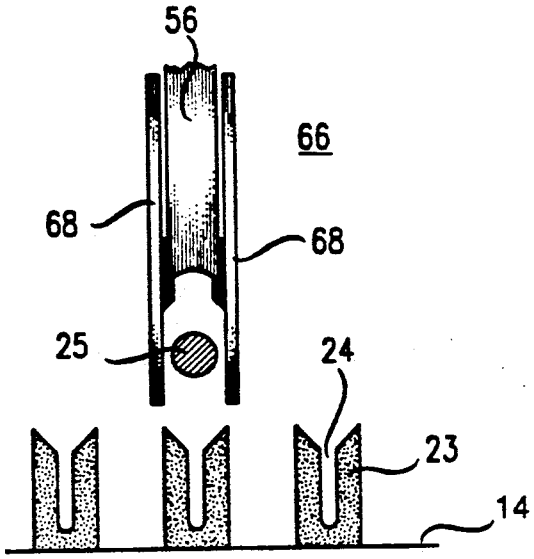
FIG. 5B
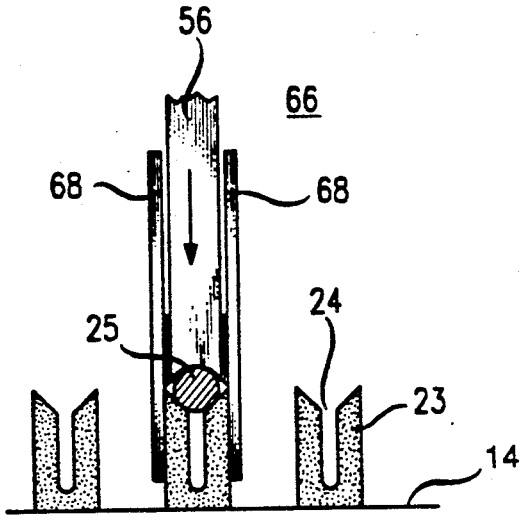
FIG. 5C
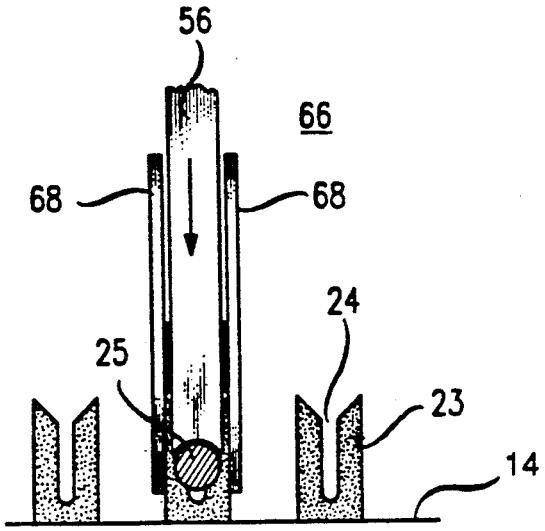

METHOD AND APPARATUS FOR ATTACHING SUCCESSIVE PAIRS OF WIRES TO A DATA CONNECTOR HAVING FINE-PITCH CONTACTS

TECHNICAL FIELD

This invention relates to a machine, and its method of use, for attaching successive pairs of wires in a cable to successive pairs of opposed, closely spaced contacts in a data connector.

BACKGROUND OF THE INVENTION

Within the electronics and telecommunications industries, multiconductor cables are still widely employed to interconnect two pieces of electronic equipment. To accomplish such interconnection, the cable usually has each of its ends terminated by a connector designed to mate with a complementary connector on the piece of equipment to be connected to the cable. A large majority of the connectors employed to terminate the ends of a multiconductor cable are comprised of two rows of opposed contacts held in an insulative member, usually made of plastic or the like. Each contact in the connector typically has a first end adapted to mate with a corresponding contact of another connector, and a second end provided with a wire-piercing barb. Attachment of a wire to a corresponding one of the contacts of the connector is accomplished by ramming a wire against the barb on the contact until the barb pierces the wire to make an electrical connection with the metal conductor inside it.

In the past, successive pairs of wires have been attached to successive pairs of opposed contacts of a connector manually, or with the aid of bulky and expensive connector attachment machines. Recently, there was developed a more compact connector attachment apparatus described in U.S. Pat. No. 4,903,399, issued on Feb. 27, 1990, to K. H. Billingham et al., and assigned to AT&T (herein incorporated by reference). The Billingham et al. connector attachment apparatus comprises a base plate having a connector-carrying carriage slidably mounted to it for movement along a first axis. Lying on opposite sides of the carriage path is a separate one of a pair of ram assemblies, each having a knife blade movable to and from the carriage to ram a separate one of a pair of wires against a separate one of a pair of opposed contacts in the connector carried by the carriage. A wire guide is provided adjacent to each of the ram assemblies for guiding a separate one of pair of wires into alignment with the knife blade of the corresponding ram assembly. A carriage advancement mechanism is provided for advancing the carriage to align each of a successive pair of opposed contacts with a separate one of the ram assemblies.

The Billingham et al. connector attachment tool has proven extremely useful for attaching successive pairs of wires to successive pairs of opposed contacts of a wide variety of connectors. However, a problem may be incurred when using the Billingham et al. apparatus to attach successive pairs of wires to the contacts of a "miniature"-type data connector because the contacts within this type are made very thin, and the barbs made very small, in order to achieve very close spacing therebetween. As a result, the contacts often distort when the wires are rammed thereagainst during the wire-attachment process.

Thus, there is a need for a connector attachment apparatus which reduces the incidence of distortion of the connector contacts as successive pairs of wires are attached thereto.

With the miniature-type data connectors, another problem is often incurred in connection with attaching successive pairs of wires to successive pairs of the connector contacts. The relatively small size and bulk of the contacts within the miniature data connector makes it difficult for the barb on the contact to firmly engage a wire rammed thereagainst. For this reason, a strain relief, usually in the form of a bar of plastic or the like, is attached to the connector to overlie each row of contacts to maintain the wires attached to the contacts in the row in firm engagement therewith.

Presently, attachment of each of a pair of strain reliefs to the miniature-type data connector is accomplished separately and apart from attachment of the wires to the connector contacts. With present day connector attachment apparatus, the connector, with the wires attached thereto, must be removed from the attachment apparatus prior to attachment of the strain relief. In the process of handling the connector, one or more of the wires attached to the contacts often become detached before attachment of the strain relief can be perfected, necessitating re-attachment of the wire, which is inconvenient to say the least.

Thus, there is a need for a connector attachment apparatus for attaching successive pairs of wires to successive pairs of opposed contacts in a connector, as well as for attaching one or more strain reliefs to the connector, without the need to manually handle the connector between these two operations.

SUMMARY OF THE INVENTION

Briefly, in accordance with a first preferred embodiment of the invention, there is provided an improved connector attachment apparatus comprised of a base plate having a connector-carrying carriage slidably mounted to the base plate for movement along a first axis. On opposite sides of the carriage path is a separate one of a pair of ram assemblies, each having a knife blade movable to and from the carriage to ram a wire against one of a pair of opposed contacts in the connector carried by the carriage. To prevent distortion of the contacts during wire attachment, the knife blade of each ram assembly is provided with a contact protector assembly spring-biased to, and extending forward from, the knife for straddling the contact. As the knife blade is displaced towards the contact to ram a wire against it, the contact protector straddles the contact to prevent it from bending or becoming distorted. A wire guide is provided adjacent to each of the ram assemblies for guiding a separate one of a pair of wires with the knife blade of a corresponding one of the ram assemblies. Lastly, a carriage advancement mechanism is provided for advancing the carriage to align each of a successive pair of opposed contacts with a separate one of the ram assemblies.

In accordance with another aspect of the invention, a connector attachment tool is provided for both attaching successive pairs of wires to successive pairs of opposed contacts of a connector as well as for attaching at least one strain relief, and preferably two strain reliefs, one on each side of the connector, following wire attachment. The connector attachment apparatus, in addition to including a mechanism for attaching successive pairs of wires to successive pairs of opposed contacts, also includes a mechanism for attaching at least one, and preferably a pair of, strain reliefs to the connector following attachment of successive pairs of wires to successive pairs of contacts in the connector. The strain relief attachment mechanism comprises at least one and, preferably, a pair of hoppers, each located downstream of a separate one of the ram assemblies on opposite sides of the path of carriage movement. Each hopper is generally comprised of a pair of spaced-apart uprights for holding a stack of strain reliefs. At the base of each pair of the uprights is a slot sized to receive a plate. The plate is reciprocated through the slot by means of an actuator to urge the bottom-most one of the strain reliefs in the stack out from the hopper and against the connector for attachment thereto once the connector has been displaced so as to lie between the two pairs of uprights. In this way, each of a pair of strain reliefs may be attached without the need to remove the connector from the connector attachment apparatus, thereby minimizing the need to manually handle the connector prior to attachment of the strain reliefs.

BRIEF DESCRIPTION OF THE DRAWING

FIGS. 5*a*, 5*b* and 5*c* show the sequence of movement of the knife blade of FIG. 4 as it is displaced toward a contact on the connector of FIG. 1.

DETAILED DESCRIPTION

Figure 1:
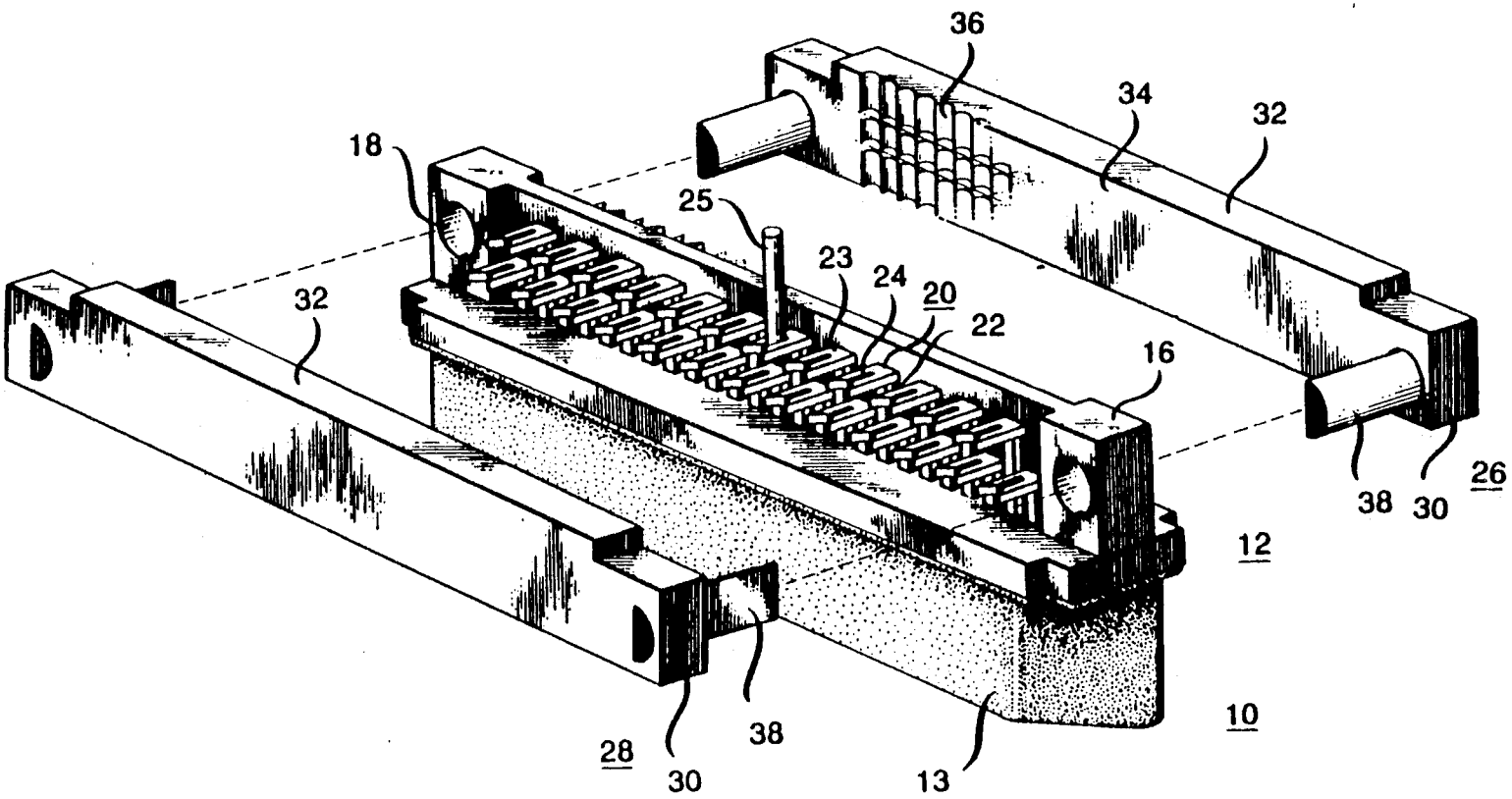
FIG. 1 (PRIOR ART)
FIG. 1 is an exploded view of a prior art data connector containing two rows of fine-pitch contacts.

The present invention is directed to an apparatus for attaching successive pairs of wires to successive pairs of opposed, closely spaced (e.g. "fine-pitch") contacts in a data connector. Before proceeding to described the apparatus, a brief description of the connector will prove useful. Referring to FIG. 1, there is shown an exploded view of a data connector 10 according to the prior art. The connector 10 is comprised of an insulative member 12, made from plastic or the like, with a lower portion 13, as seen in FIG. 1, which is generally prismatic in shape, with rounded corners, to facilitate mating with a complementary connector of the same variety and an upper portion 14. The upper portion 14 of the member 12 is shaped in the form of a long, thin prismatic wall, having a separate one of a pair of ears 16 at each of its ends. Each of the ears 16 has a passage 18 extending horizontally therethrough whose purpose will become better understood hereinafter.

The wall 14 serves to separate each of a pair of rows of closely spaced electrical contacts 20 from the other. Each of the contacts 20 in each row is comprised of a shaft 22 which extends into the lower portion 13 of the member 12 to make an electrical connection with a contact on a connector mating with the connector 10. Integral with the upper end of the shaft 22 is a barb 23 comprised of a thin horizontal portion having a V-shaped slot 24 designed to pierce the insulation on a wire 25 rammed into the slot.

In order to make the connector 10 very compact, the center-to-center spacing of the contacts 20 in each row is made small, typically on the order of 50 mils. For this reason, the connector 10 is said to have "fine-pitch" contacts 20. In order to facilitate such close spacing, the size and bulk of the shaft 22 as well the barb 23 of each contact 20 are reduced. Further, the height of the barbs on the contacts 20 is staggered so that every other barb lies below each of its neighbors on opposite sides.

The reduced bulk of the barb 23 on each contact 20 tends to prevent the barb from firmly engaging the wire 25 rammed into the slot 24. In other words, after a wire 25 is rammed into the V-shaped slot 24, the wire may be easily dislodged from the barb even when only a moderate force is applied. To maintain each of the wires 25 in firm engagement with the slot 24 in the barb 23, each of a left-hand and right-hand pair of strain reliefs 26 and 28 is attached to the right-hand and left-hand one of the sides, respectively, of the wall 14 so as to overlie the contacts in the row on the corresponding side of the wall.

As seen in FIG. 1, each of the strain reliefs 26 and 28 comprises a bar 30, made from plastic or the like, and having either a square or rectangular cross section. The bar 30 has a raised lip 32 on its upper surface, the ends of the lip being spaced a short distance from the ends of the bar. The lip 32 serves to impart a particular shape to the bar 30 such that when the lip is facing upward, the bar is said to be right-side up. On a first longitudinal face 34 of the bar 30 of each of the strain reliefs 26 and 28 is a plurality of half-rounded vertical channels 36 spaced apart a distance about the same as the contacts 20 in each row on the connector 10. The channels 36 each serve to partially seat a separate one of the wires 25 rammed against each contact 20 when each of the strain reliefs 26,28 overlies a separate one of the right-hand and left-hand row of contacts.

Each of the strain reliefs 26 and 28 is attached to the connector 10 by way of a pair of half-rounded cylindrical posts 38 which extend horizontally outwardly from the face 34 of the bar 30 for receipt in a separate one of the passages 18 in the ears 16 in the wall 14. As may be appreciated from FIG. 1, the posts 38 on the right-hand strain relief 26 are oriented such that each has its flat face looking leftward in the figure while the posts on the left-hand strain relief 28 have their flat face looking rightward. In this way, there will be no interference when each of the right-hand and left-hand posts 38 of both strain reliefs 26 and 28 are received in a separate one of the right-hand and left-hand passages 18.

Figure 2:
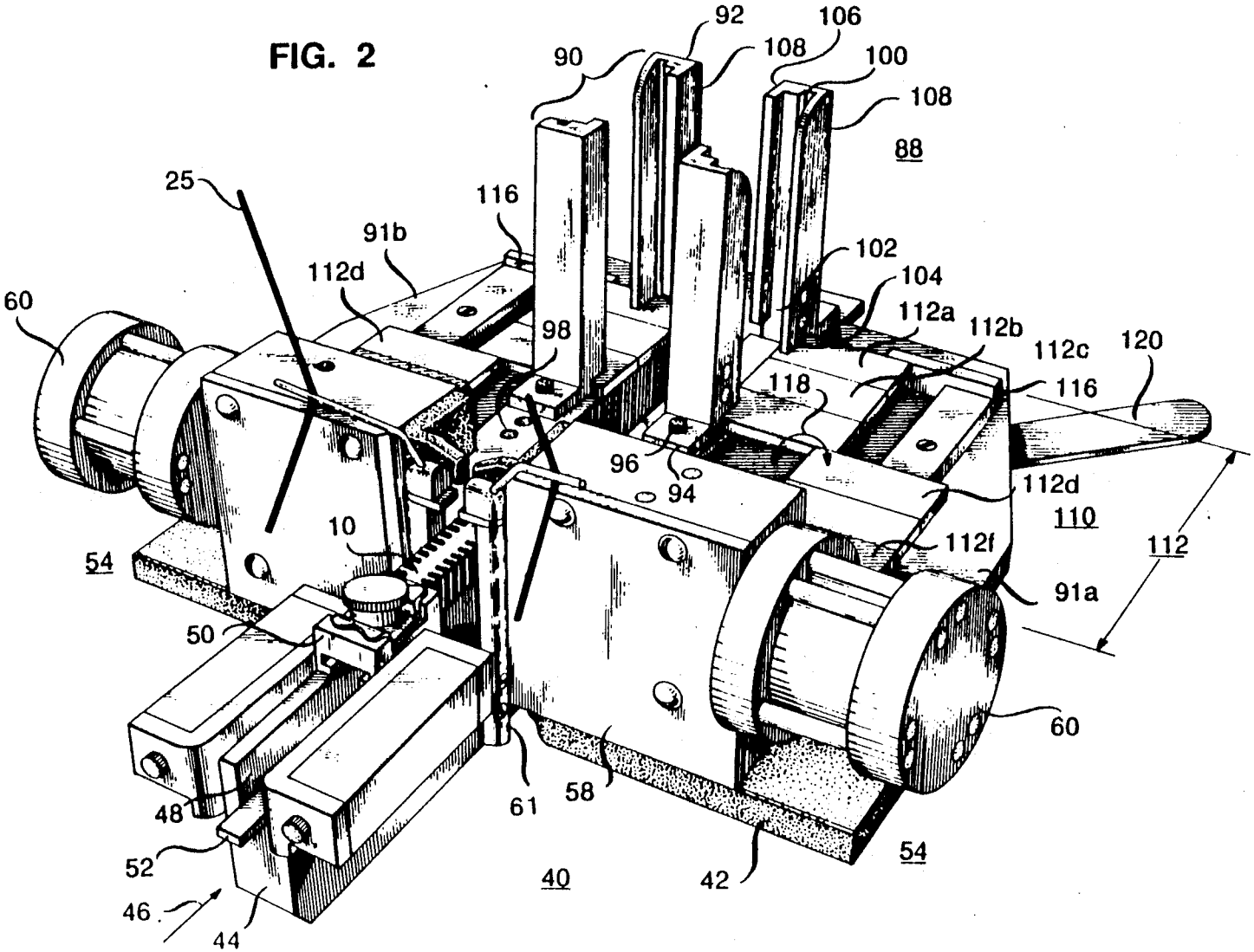
FIG. 2 is a perspective view of an apparatus in accordance with the present inventin for attaching successive pairs of wires to successive pairs of contacts in the connector of FIG. 1 as well as for attaching each of a pair of strain reliefs thereto.
Figure 3:
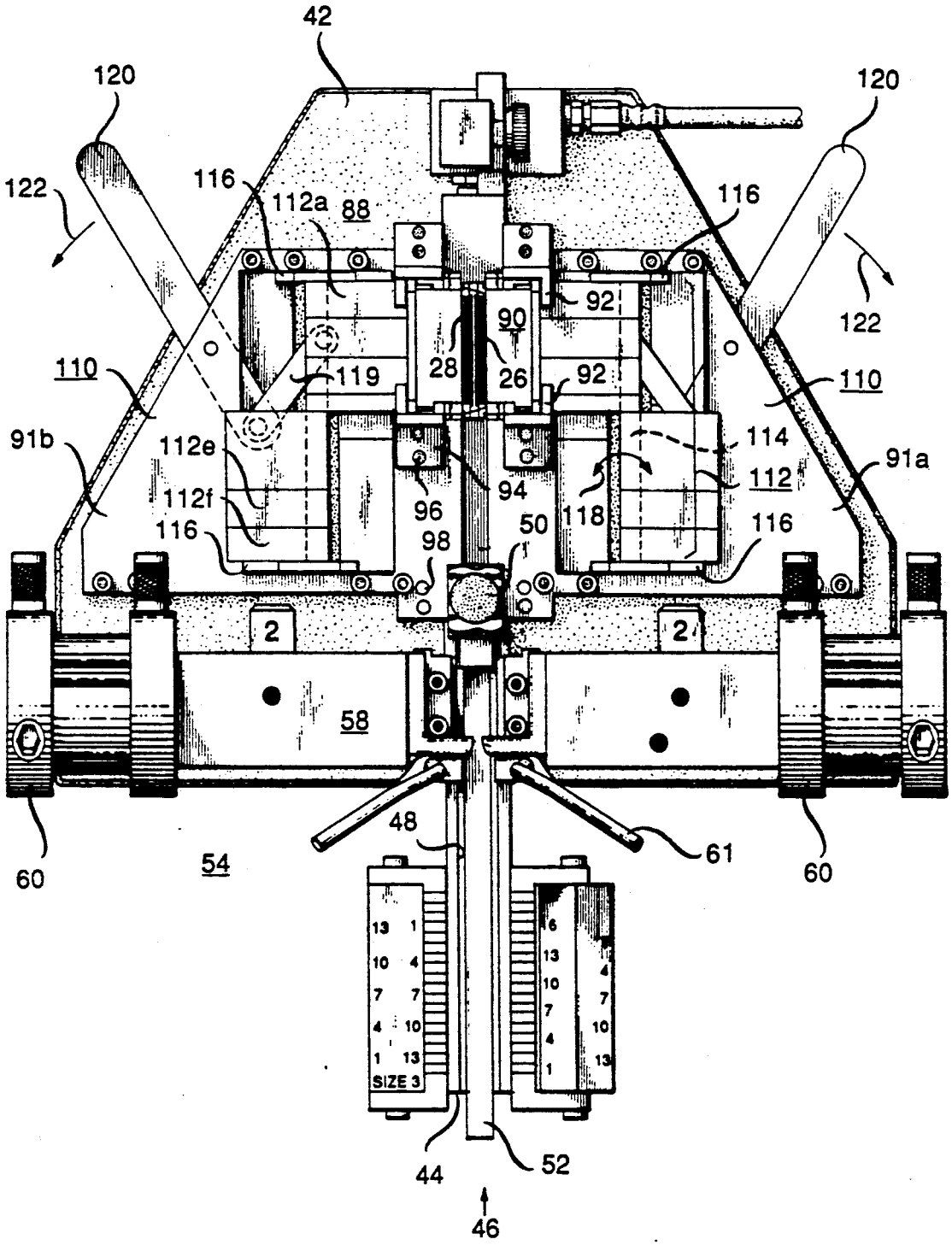
FIG. 3 is a plan view of the connector attachment apparatus of FIG. 2.

Referring now to FIGS. 2 and 3, there is shown an apparatus 40, in accordance with the present invention, for attaching each of a successive pair of wires 25 to each of a successive pair of opposed contacts 20 (see FIG. 1) in the connector 10 and for attaching each of the right-hand and left-hand strain reliefs 26 and 28 (see FIG. 1) to the connector as well. As best seen in FIGS. 2 and 3, the connector attachment apparatus 40 is generally similar to that disclosed in the Billingham et al. U.S. Pat. No. 4,903,399, herein incorporated by reference. In this regard, the connector attachment apparatus 40 includes a base plate 42 which mounts an upwardly rising wall 44 that runs on the plate along a first axis 46. Within the top of the wall 44 is a slot 48 which runs along the axis 46. The slot 48 serves to receive a connector-carrying carriage 50 slidably mounted for movement in the wall 44 along the axis 46. A mechanism 52, only a portion of which is shown in FIG. 2, is provided for incrementally displacing the carriage 50 along the wall 44. For a further discussion of the carriage-advancing mechanism 52, reference should be had to the aforementioned Billingham et al. patent.

Figure 4:
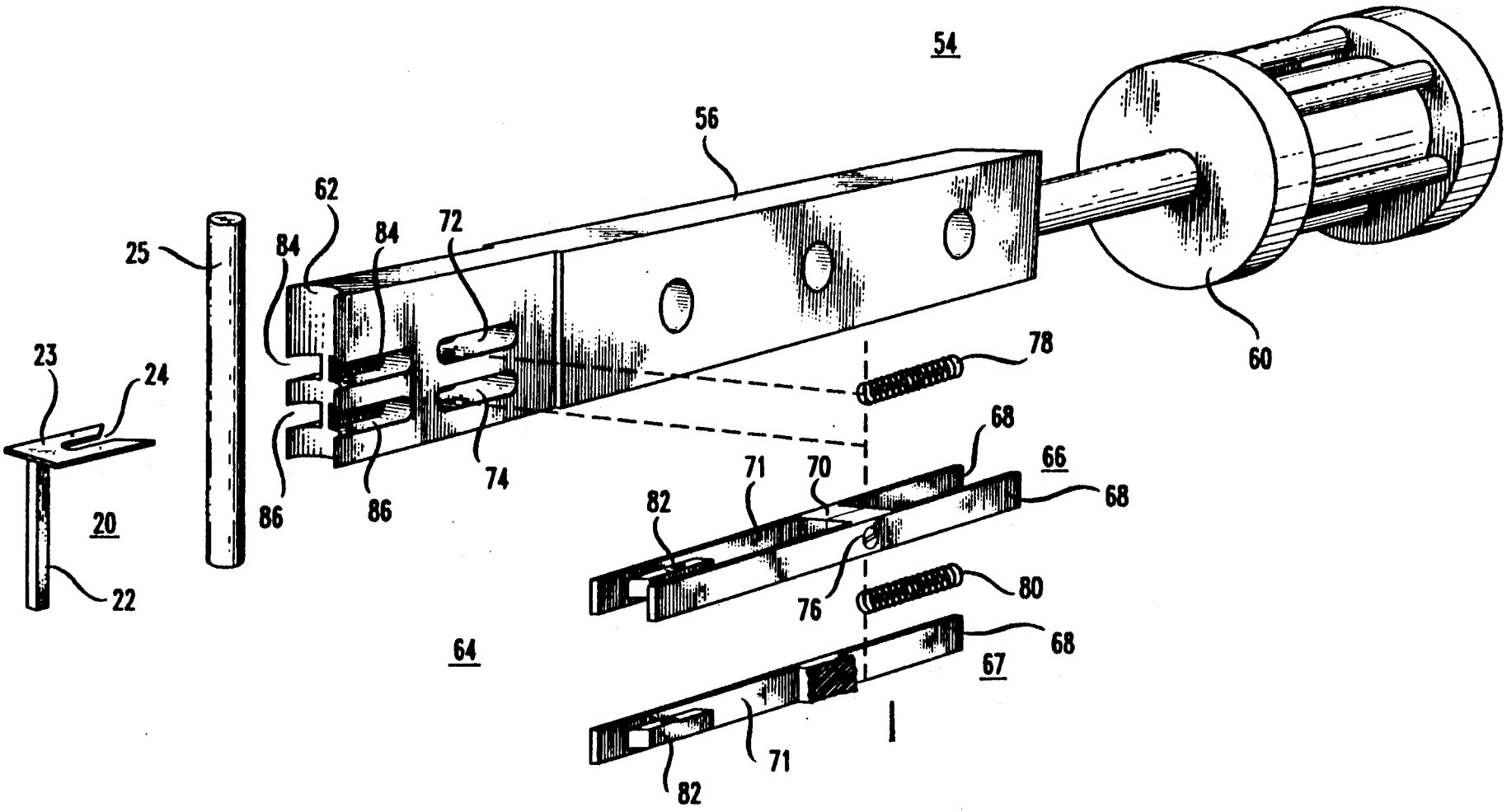
FIG. 4 is an exploded view of a knife blade assembly comprising a portion of the connector attachment apparatus of FIGS. 2 and 3.

Each of a pair of ram assemblies 54 is mounted to the base plate 40 perpendicular to, and on opposite sides of, the wall 44 so as to lie on opposite sides of the path of travel of the carriage 50. Each of the ram assemblies 54 includes a knife blade 56 (see FIG. 4) slidably mounted within a housing 58 (see FIG. 2) for movement to and from the carriage 50 along an axis perpendicular to the axis 46. The knife blade 56 of FIG. 4 is reciprocated to and from the carriage 50 by an actuator 60, which, in a preferred embodiment, takes the form of an air cylinder. In practice, the air cylinder 60 of each ram assembly 54 is actuated in unison with the air cylinder associated with the other ram assembly. By actuating the ram assemblies 54 in unison, the knife blades 56 are displaced forward towards the connector 10 to attach each of a pair of wires 25 to each of a pair of opposed contacts 20 (see FIG. 1). To facilitate attachment of a wire 25 to a contact 20, a separate one of a pair of wire guides 61 is situated adjacent to each ram assembly 54 to align a wire with the forward end of the knife blade 56. Each wire guide 61 is similar to the wire guide described in U.S. patent application, Ser. No. 555,958, filed July 23, 1990, in my name and assigned to the instant assignee, herein incorporated by reference.

Referring now to FIG. 4, the knife blade 56 of each ram assembly 54 has a vertically running concavity 62 at its forward (leftward) end. The concavity 62 at the forward end of each knife blade 56 serves to partially seat the wire 25 to be rammed into the slot 24 on the barb 23 of the contact 20 to maintain the wire centered with the slot. To reduce the incidence of bending and distortion of the barb 23 on the contact 20 during wire attachment, the knife blade 56 of each ram assembly 54 is advantageously provided with a contact protector assembly 64 in accordance with the invention.

As seen in FIG. 4, the contact protector assembly 64 comprises upper and lower, generally "H-shaped" members 66 and 67, the lower member only being partially illustrated in FIG. 4. The members 66 and 67 are each configured of a pair of prismatic strips 68 which each have a block-like projection 70 extending horizontally outwardly from a first longitudinal face 71 thereof for abutment with, and attachment to, the block-like projection of the other strip, thus establishing the H-shaped configuration of each member. To facilitate mounting of the member 66 such that each of the strips 68 lies on opposite sides of the knife blade 56, the blade is provided with an elongated slot 72 a short distance rearward of the concavity 62, the slot being sized to accommodate the projection 70 on each of the strips. Similarly, a second elongated slot 74 is provided in the knife blade 56 directly below the slot 72 to accommodate the projection 70 on each of the strips 68 of the second member 67 (only one such strip is illustrated in FIG. 4). The height of the slots 72 and 74 corresponds to the height of the upper and lower barbs 23 in a separate one of the rows of the contacts 20 in the connector 10 of FIG. 1.

As seen in FIG. 4, a threaded fastener 76 extends through the projection on the right-hand one of the strips 68 of each of the members 66 and 67 into the projection 70 of the other strip of the same member to secure the strips together after the strips have been situated on opposite sides of the knife blade 56. Each of a pair of compression springs 78 and 80 is interposed between a separate one of the members 66 and 67 and the rearward wall of a separate one of the slots 72 and 74, respectively, to bias the member forward of the knife blade 56.

Extending horizontally outward from the face 71 of each strip 68 of each of the members 66 and 67 is a second projection 82 which is forward (leftward) of the first projection 70. The second projections 82 on the strips 68 of the first member 66 each ride in a separate one of a first pair of grooves 84, located on opposite sides of the knife blade 56, forward of, and at the same height as, the slot 72. Similarly, the second projections 82 on the strips 68 of the second member 67 each ride in a separate one of a pair of grooves 86 situated on opposite sides of the knife blade 56 directly below a separate one of the grooves 84. The grooves 84 and 86 each serve to maintain a separate one of the members 66 and 67 parallel to the horizontal axis of the blade 56, so as to guide that member when biased rearwardly along the blade in a manner described below.

To best understand how the contact protector assembly 64 protects the barb 23 on each contact 20 in FIG. 1, reference should be had to FIG. 5A, which is a plan view of a portion of the connector 10 (see FIG. 1) at the outset of the wire attachment process. For ease of discussion, it will be assumed that the particular barb 23 to which the wire 25 is being attached is at the same height as the member 66, so only the operation of that member will be described, it being understood that the member 67 (see FIG. 4) operates in exactly the same manner, except on the lower height barbs.

At the outset of the attachment operation, a wire 25 is first aligned (by the wire guide 61 of FIG. 2) with the knife blade 56 for attachment to a particular one of the contacts 20 (assumed to have a barb at the same height as the member 66). When aligned with the knife blade 56, the wire 25 will be captured between forward ends of the strips 68 of the member 66. At this time, the blade 56 is retracted so that the blade, and the member 66, are spaced from the barb 23.

Referring to FIG. 5B, the next step in the wire-attachment process is to displace the knife blade 56 forward (downward in the figure) in towards the barb 23 opposite to the blade. As the knife blade 56 is displaced toward the barb 23, the forward end of the strips 68 of the member 66 extending beyond the blade will move along opposite sides of the barb. As indicated previously, the spacing between the strips 68 is just slightly greater then the width of the barb 23 so that the barb will be tightly straddled by the strips as the knife blade 56 is urged forward.

Referring to FIG. 5C, the forward displacement of the knife blade 56 continues until the blade forces the wire 25 into the slot 24 in the barb 23 so that the wire is firmly retained therein. Before the knife blade 56 reaches its forwardmost position, the forward end of the strips 68 of the member 66 typically will have already contacted the wall 14 on the connector 10 (see FIG. 1). Since the member 66 is spring-biased to the knife blade 56 by virtue of the spring 78 of FIG. 4, the blade can continue to move forward while the member is urged against the spring. During this time, the strips 68 continue to straddle the barb 23, preventing the barb from becoming distorted due to the force of blade 56 against the wire 25 which is transmitted to the barb.

Referring to FIGS. 2 and 3, in accordance with another aspect of the invention, the connector attachment tool 40 is advantageously provided with a mechanism 88 for attaching the right-hand and left-hand strain reliefs 26 and 28 of FIG. 1 to the right-hand and left-hand sides, respectively, of the connector 10 once the requisite contacts 20 (see FIG. 1) in each of the rows has had a wire 25 attached to it. As best seen in FIG. 2, the strain relief attachment mechanism 88 comprises a right-hand and left-hand hopper 90, each carried by a separate one of a pair of plates 91*a* and 91*b*. Each of the plates 91*a* and 91*b* is mounted to the base plate 42 on opposite sides of the wall 44 so as to lie in spaced-apart parallelism above the base plate. Each hopper 90 is situated downstream of a separate one of the ram assemblies 54 (in terms of the path of travel of the carriage 50 rightwardly along the axis 46) so that each hopper lies on opposite sides of the wall 44. The hoppers 90 are each comprised of a pair of spaced-apart uprights 92, each having a flanged base 94 attached to a corresponding one of the plates 91*a* and 91*b* by way of a threaded fastener 96 which is received in a separate one of a set of spaced-apart, threaded passageways 98 arranged parallel to the axis 46. The spacing between the uprights 92 can be varied depending on which of the threaded passageways 98 is chosen to receive the fastener 96.

Each of the uprights 92 has a generally U-shaped vertical channel 100 which is oriented so as to oppose the channel in the other upright of the pair comprising the hopper 90. The channels 100 in the uprights 92 comprising the right-hand hopper 90 are configured to receive the ends of the right-hand strain relief 26 while the channels in the uprights comprising the left-hand hopper are configured to receive the ends of the left-hand strain relief 28. Only the right-hand and left-hand strain reliefs will properly fit in the right-hand and left-hand hoppers 90, respectively. Although not shown in FIG. 2, the right-hand and left-hand hoppers 90, each hold a quantity of the right-hand and left-hand strain reliefs 26 and 28, respectively, in a vertical stack such that the posts 38 (see FIG. 1) on the strain reliefs in the stack in each hopper oppose those held in the other hopper.

Referring to FIG. 2, the channel 100 in each upright communicates with a pair of horizontal slots 102 and 104, each extending through a separate one of the forward and rearward faces 106 and 108 of each upright near the base thereof. The slot 102 in the forward upright face 106 in the uprights 92 of each of the hoppers 90 is sized to permit the bottom-most one of the strain reliefs 26,28 in the stack to be pushed out of the hopper in the manner described below.

Referring both to FIG. 3, the bottom-most one of the right-hand and left-hand strain reliefs 26 and 28 in the right-hand and left-hand hoppers 90, respectively, is pushed out from its respective hopper for attachment to the right-hand and left-hand sides of the connector 10 of FIG. 1, respectively, by a separate one of a pair of pusher mechanisms 110. Each pusher mechanism 110 comprises a pusher plate 112 which is configured of a plurality of pusher plate segments (typically six in number) 112*a*, 112*b*, 112*c*, 112*d*, 112*e* and 112*f*. The pusher plate segments 112*a*, 112*b*, 112*c*, 112*d*, 112*e* and 112*f* are each of a thickness slightly less than the height of the slot 104 through the rearward face 108 of the uprights 92 of the right-hand and left-hand hoppers 90 so that one or more of the segments can be received through the slot. A shaft 114 extends through the pusher plate segments 112*a*, 112*b*, 112*c*, 112*d*, 112*e* and 112*f* of each pusher plate 112 adjacent to the rearward end of each segment (the end furthest from the hopper 90). Each of the ends of the shaft 114 is journaled for lateral movement in a separate one of a pair of ways 116 fastened to a corresponding one of the plates 91*a* and 91*b* to permit the shaft, and the segments 112*a*, 112*b*, 112*c*, 112*d*, 112*e* and 112*f* of the pusher plate 112, to move laterally into and out of the slots 104 in a direction perpendicular to the axis 46.

The segments 112*a*, 112*b*, 112*c*, 112*d*, 112*e* and 112*f* of each pusher plate 112 are rotatable about the shaft 114 through an approximately 180° arc 118 as seen in FIG. 2. The purpose in allowing the segments 112*a*, 112*b*, 112*c*, 112*d*, 112*e* and 112*f* to rotate through the arc 118 is allow a larger or smaller number of segments of the pusher plate 112 to be positioned for receipt through the slot 102. Thus, when the uprights 92 of the right-hand and left-hand hoppers 90 are spaced far apart to accommodate long right-hand and left-hand strain reliefs 26 and 28, respectively, a larger number of the segments 112*a*, 112*b*, 112*c*, 112*d*, 112*e* and 112*f* will be rotated to pass through the lot 102 in the uprights. Conversely, when the uprights 92 of the right-hand and left-hand hoppers 90 are spaced close together to accommodate relatively short right-hand hand and left-hand strain reliefs 26 and 28, respectively, only a few of the segments 112*a*, 112*b*, 112*c*, 112*d*, 112*e* and 112*f* will be rotated for insertion through the slots 102.

Referring to FIG. 3, each pusher plate 112 is displaced to and from its associated hopper 90 by the combination of a link 119 and a lever 120. The link 119 has a first one of its ends rotatably pinned to the undersurface of the segment 112*b* of the pusher plate 112 of a separate one of the pusher mechanisms 110 while the opposite end of the link is rotatably pinned to a first end of the lever 120 which extends outwardly from underneath a separate one of the plates 91*a* and 91*b* to a point beyond the base plate 42. The lever 120 associated with each pusher plate 112 is rotatably pinned to a separate one of the plates 91*a* and 91*b* at a point on the lever beyond the end pinned to the link 119 so that the lever can be rotated through an arc 112.

When the lever 120 of each associated pushing mechanism 110 is rotated through its arc 122 in a first direction, the segments 112*a*, 112*b*, 112*c*, 112*d*, 112*e* and 112*f* of the pusher plate 112 which have been rotated towards the associated pair of uprights 92 will be displaced into the slot 104 in the upright. In this way, the bottom-most one of the strain reliefs 26 and 28 in the corresponding one of the right-hand and left-hand hoppers 90 will be forced therefrom and attached to the connector 10 (see FIG. 1) once the carriage 50 has been displaced so as to be interposed between the hoppers. In practice, the carriage 50 is manually advanced rearwardly so as to lie between the right-hand and left-hand hoppers 90 after each of a successive pair of wires has been attached to each of a successive pair of the contacts 20. The strain reliefs 26 and 28 are then attached as just described while the connector 10 still remains in the carriage 50, thus avoiding the need to handle the connector prior to attachment of the strain reliefs.

The foregoing discloses a connector attachment apparatus 40 which serves to attach successive pairs of wires 25 to successive pairs of closely spaced contacts 20 in a connector 10 with reduced incidence of contact distortion. Further, the apparatus 40 also serves to attach each of a pair of right-hand and left-hand strain reliefs 26 and 28 to the right-hand and left-hand sides of the connector 10 after attachment of the wires 25 to the connector contacts 20 without the need to manually handle the connector between these operations.

It is to be understood that the above-described embodiments are merely illustrative of the principles of the invention. Various modifications and changes may be made thereto by those skilled in the art which will embody the principles of the invention and fall within the spirit and scope thereof.

I claim:

1. A method for attaching each of a pair of wires to each of a pair of opposed contacts in a connector comprising the steps of:

incrementally advancing a connector past each of a pair of opposing knife blades to align each of a pair of opposed contacts in the connector opposite a separate one of the blades;

aligning each of a pair of wires opposite a separate one of the knife blades; and displacing each of the knife blades towards a separate one of the contacts to ram the wire aligned with the blade against the contact for attachment thereto, wherein the improvement comprises the step of:

yieldably biasing a contact protector slidably along each knife blade to tightly straddle the contact prior to and during wire insertion as each knife blade rams the wire against the contact to reduce the incidence of contact deformation and distortion.

2. The method according to claim 1 further including the steps of:

advancing the connector to a strain relief attachment station following attachment of each of a plurality of successive pairs of wires to each of a successive pair of opposed contacts; and attaching at least one strain relief to the connector at the strain relief attachment station.

3. A method for attaching each of a pair of wires to each of a pair of opposed contacts in a connector comprising the steps of:

incrementally advancing a connector past each of a pair of opposing knife blades to align each of a pair of opposed contacts in the connector opposite a separate one of the blades;

aligning each of a pair of wires opposite a separate one of the knife blades; and displacing each of the knife blades towards a separate one of the contacts to ram the wire aligned with the blade against the contact for attachment thereto, wherein the improvement comprises the steps of:

advancing the connector to a strain relief attachment station following attachment of each of a plurality of successive pairs of wires to each of a successive pair of opposed contacts; and attaching at least one strain relief to the connector at the strain relief attachment station.

4. The method according to claim 3 wherein the step of attaching a strain relief to the connector comprises the steps of:

loading a hopper at the strain relief attachment station with at least one strain relief; and displacing a plate-shaped ram laterally through a slot in the hopper to urge a strain relief therein out from the hopper and against the connector for attachment thereto.

5. An apparatus for successively attaching each of a pair of wires in a cable to a respective one of a pair of opposed contacts in a separate one of a pair of rows in a connector comprising:

a base plate;

a connector-carrying carriage slidably mounted on the plate for movement along a first axis;

a pair of ram assemblies, each carried by the base plate and located on opposite sides of the carrige path, each ram assembly including a knife blade mounted for movement to and from the carriage along an axis perpendicular to the first axis for ramming a separate one of a pair of wires against a separate one of a pair of opposed contacts to attach each of the wires to a corresponding contact;

a pair of wire guides, each located adjacent to and operably associated with, a separate one of the ram assemblies, for guiding a wire pulled thereacross by an operator into alignment with the knife blade of the corresponding ram assembly to facilitate attachment of the wire to a corresponding contact by the knife blade; and means carried by the carriage and operably associated with the base plate for displacing the carriage along the first axis to align each of a successive pair of contacts with a separate one of the ram assemblies; wherein the improvement comprises:

a contact protector assembly carried by, and slidably mounted to, so as to extend beyond the knife blade of each ram assembly for tightly straddling a separate of the contacts, prior to, during attachment of the wire as the knife blade is displaced towards the contact, to constrain the contact against bending and distortion.

6. The apparatus according to claim 5 further including a mechanism carried by the base plate and operably associated with the carriage for attaching at least one of a pair of strain reliefs to the connector to overlie a separate one of the rows of contacts.

7. The apparatus according to claim 6 wherein the contact protector assembly comprises:

a first pair of strips, each slidably mounted to an opposite one of the sides of the knife blade so as to extend forward therefrom in spaced parallelism a distance laterally apart and slightly greater than the width of the contact so as to be capable of tightly straddling the contact therebetween when the knife blade is urged forward to ram a wire against the contact for attachment thereto; and spring means for biasing the first pair strips foward of the knife blade.

8. The apparatus according to claim 7 wherein each of the strips of the first pair includes guide means which cooperate with the knife blade to guide the strips therealong when biased rearward relative to the blade.

9. The apparatus according to claim 7 wherein the contact protector assembly further includes:

a second pair of strips, each slidably mounted to an opposite one of the sides of the knife blade below a separate one of the first pair of strips so as to extend forward from the blade, the second pair of strips being in spaced parallelism with each other and spaced laterally apart slightly greater than the width of a contact at the same height thereof so as to be capable of straddling such contact therebetween when the knife blade is urged forward to ram a wire against such contact for attachment thereto; and second spring means for biasing the second pair of strips forward of the knife blade.

10. The apparatus according to claim 9 wherein each of the strips of the second pair includes guide means which cooperate with the knife blade to guide each of the second pair of strips therealong when biased rearward relative to the blade.

11. The apparatus according to claim 6 wherein the strain relief attaching mechanism comprises:

a first hopper located downstream of a separate one of the ram assemblies so as to lie on one of the sides of the carriage, the first hopper holding a stack of strain reliefs in an orientation for attachment to the side of the connector and the hopper having a slot at its base to permit a bottom-most strain relief to be forced out through the slot towards the connector, and first actuator means associated with the first hopper for forcing the bottom-most strain relief through the slot at the hopper base towards the connector carried by the carriage for attachment to the connector.

12. The apparatus according to claim 11 wherein the strain relief attaching means further includes:

a second hopper carried by the base plate and located downstream of the other of the ram assemblies so as to lie on an opposite side of the carriage from the first hopper for holding a stack of strain reliefs in an orientation for attachment to the other side of the connector, the hopper having a slot at its base to permit a bottom-most strain relief to be forced out through the slot towards the connector; and second actuator means located at the bottom of, and operably associated with, the first hopper for forcing the bottom-most strain relief in the hopper through the slot at the hopper base towards the connector carried by the carriage for attachment to the connector.

13. The apparatus according to claim 12 wherein each of said first and second hoppers comprises a pair of uprights, each having a channel therein opposite the channel in the other upright for capturing a separate one of the ends of each of a plurality of vertically stacked strain reliefs.

14. The apparatus according to claim 12 wherein each of the actuator means comprises:

a plate comprised of a plurality of segments each capable of being rotated about a common axis between a first orientation at which the segment is positioned for insertion into the slot in the hopper to force the bottom-most strain relief therefrom, and a second position distant from the hopper; and means connected to the plate for urging the plate to and from the hopper so that at least one of the segments is inserted into the slot in the hopper.

15. An apparatus for successively attaching each of a pair of wires in a cable to a respective one of a pair of opposed contacts in a separate one of a pair of rows in a connector comprising:

a base plate;

a connector-carrying carriage slidable mounted on the base plate for movement along a first axis;

a pair of ram assemblies, each carried by the base plate and located on opposite sides of the carriage path, each ram assembly including a knife blade mounted for movement to and from the carriage along an axis perpendicular to the first axis for ramming a separate one of a pair of wires against a separate one of a pair of opposed contacts to attach each of the wires to a corresponding contact;

a pair of wire guides, each located adjacent to and operably associated with, a separate one of the ram assemblies, for guiding a wire pulled thereacross by an operator into alignment with the knife blade of the corresponding ram assembly to facilitate attachment of the wire to a corresponding contact by the knife blade; and means carried by the carriage and operably associated with the base plate for displacing the carriage along the first axis to align each of a successive pair of contacts with a separate one of the ram assemblies; WHEREIN the improvement comprises a mechanism for attaching at least one of a pair of strain reliefs to the connector to overlie a separate one of the rows of contacts.

16. The apparatus according to claim 15 wherein the strain relief attaching mechanism comprises:

a first hopper carried by the base plate and located downstream of a separate one of the ram assemblies so as to lie on one of the sides of the carriage, the first hopper holding a stack of strain reliefs in an orientation for attachment to the side of the connector and the hopper having a slot at its base to permit bottom-most strain relief to be forced out through the slot towards the connector; and first actuator means located at the bottom of, and operably associated with the first hopper for forcing the bottom-most strain relief through the slot at the hopper base towards the connector carried by the carriage for attachment to the connector.

17. The apparatus according to claim 16 wherein the strain relief attaching means further includes:

a second hopper carried by the base plate, and located downstream of the other of the ram assemblies so as to lie on an opposite side of the carriage from the first hopper for holding a stack of strain reliefs in an orientation for attachment to the other side of the connector, the hopper having a slot at its base to permit a bottom-most strain relief to be forced out through the slot towards the connector; and second actuator means located at the bottom of, and operably associated with the first hopper for forcing the bottom-most strain relief in the hopper through the slot at the hopper base towards the connector carried by the carriage for attachment to the connector.

18. The apparatus according to claim 17 wherein each of said first and second hoppers comprises a pair of uprights, each having a channel therein opposite the channel in the other upright for capturing a separate one of the ends of each of a plurality of vertically stacked strain reliefs.

19. The apparatus according to claim 17 wherein each of the actuator means comprises:

a plate comprised of a plurality of segments each capable of being rotated about a common axis between a first orientation at which the segment is positioned for insertion into the slot in the hopper to force the bottom-most strain relief therefrom, and a second position distant from the hopper; and means connected to the plate for urging the plate to and from the hopper so that at least one of the segments is inserted into the slot in the hopper.

* * * * *